US005555082A

United States Patent [19]

Tanaka et al.

[11] Patent Number: 5,555,082

[45] Date of Patent: Sep. 10, 1996

[54] IMAGE FORMING APPARATUS THAT RELEASES SHEET CONVEYING FORCE AFTER THE SHEET REACHES A RECORDING MATERIAL CARRYING MEMBER

[75] Inventors: Kiyoharu Tanaka; Hajime Suzuki, both of Yokohama; Koji Kimura, Tokyo, all of Japan

[73] Assignee: Canon Kabushiki Kaisha, Tokyo, Japan

[21] Appl. No.: 134,879

[22] Filed: Oct. 12, 1993

Related U.S. Application Data

[63] Continuation of Ser. No. 773,550, Oct. 9, 1991, abandoned.

[30] Foreign Application Priority Data

Oct. 12, 1990 [JP] Japan ..... 2-275051

[51] Int. Cl.[6] ..... G03G 15/00

[52] U.S. Cl. ..... 355/309; 271/278; 355/271; 355/317

[58] Field of Search ..... 355/315, 317, 355/271, 274, 272, 308, 309, 316, 275; 271/4.01, 6, 4.09, 7, 278, 285, 307, 198, 245–6

[56] References Cited

U.S. PATENT DOCUMENTS

| | | | |
|---|---|---|---|
| 3,567,213 | 3/1971 | Lagonegro et al. | 355/317 X |
| 3,999,987 | 12/1976 | Davis et al. | 355/326 X |
| 4,135,804 | 1/1979 | Schoppe et al. | 355/315 |
| 4,361,399 | 11/1982 | Sawada et al. | 355/75 |
| 4,443,094 | 4/1984 | Riccardi | 355/319 |
| 4,449,808 | 5/1984 | Abrea | 250/325 X |
| 4,490,033 | 12/1984 | Gage et al. | 355/212 X |
| 4,552,448 | 11/1985 | Davidson | 271/277 X |
| 4,737,816 | 4/1988 | Inoue et al. . | |
| 4,743,938 | 5/1988 | Ohno | 355/327 |
| 4,942,435 | 7/1990 | Kneisel et al. | 355/311 |
| 5,078,384 | 1/1992 | Moore | 271/228 |
| 5,083,167 | 1/1992 | Fukushima et al. | 355/274 |

FOREIGN PATENT DOCUMENTS

| | | | |
|---|---|---|---|
| 0369429 | 5/1990 | European Pat. Off. . | |
| 0049961 | 3/1982 | Japan | 355/309 |
| 0063967 | 4/1983 | Japan | 355/275 |
| 60-204550 | 10/1985 | Japan . | |
| 2056914 | 3/1981 | United Kingdom . | |
| WO8303148 | 9/1983 | WIPO . | |

*Primary Examiner*—P. Thai Akh Dang

*Attorney, Agent, or Firm*—Fitzpatrick, Cella, Harper & Scinto

[57] ABSTRACT

An image forming apparatus includes an image bearing member; a recording material carrying member for carrying a recording material, wherein an image is transferred from the image bearing member to the recording material carried on the recording material carrying member; a conveyor means for conveying the recording material to the recording material carrying member; and a releasing device for for releasing the recording material from the a conveyor after a leading edge of the recording material is supported on the recording material carrying member.

18 Claims, 6 Drawing Sheets

IMAGE FORMING APPARATUS THAT RELEASES SHEET CONVEYING FORCE AFTER THE SHEET REACHES A RECORDING MATERIAL CARRYING MEMBER

This application is a continuation of application Ser. No. 07/773,550 filed Oct. 9, 1991, now abandoned.

FIELD OF THE INVENTION AND RELATED ART

The present invention relates to an image forming apparatus such as an electrophotographic or electrostatic recording apparatus, and more particularly to an image forming apparatus wherein an image is transferred from an image bearing member to a recording material carried on a recording material carrying member in the form of a transfer drum or a transfer belt or the like.

In an electrophotographic color copying machine, for example, a toner image is formed on an image bearing member in the form of a rotatable cylinder such as a photosensitive drum, and the toner image is transferred onto the transfer material (recording material), and thereafter, the toner image is fixed when a single color copy is to be produced. In the case when a multi-color image or a full-color image is to be produced, the toner image formation and the image transfer process are repeated a predetermined number of times so that the resultant toner images are superposedly transferred onto a transfer material, and they are fixed, by which a desired color image is produced. Normally, the transfer material is carried on a transfer drum comprising a drum frame covered with a transfer material carrying member, usually a high resistance film or sheet. The transfer material supplied to the transfer drum is wrapped on the transfer material carrying sheet by electrostatic attraction force applied between the transfer material carrying sheet and the transfer material at the transfer material supply position.

Japanese Laid-Open Patent Application No. 32078/1980 discloses the electrostatic attraction method.

By rotating the transfer drum with the transfer material attracted thereon, the transfer material is fed to the transfer position where the toner image is electrostatically transferred onto the transfer material from the image bearing member, so as to produce a color image.

The transfer material is fed out of the sheet feeding station and is further fed to the attracting position at a predetermined timing by a pair of conveying rollers. At the attraction position, there is a corona charger behind the transfer material carrying sheet. On the transfer material carrying sheet, the conductive roller (charge injection roller) in rolling contact with the transfer material to be attracted and retained. By the corona charger and the conductive roller applying electric charge of the polarity opposite to that of the toner image to the transfer material, the transfer material is electrostatically attracted on the transfer material carrying sheet.

Here, it is preferable that the peripheral speed of the transfer drum is equal to the conveying speed of the transfer material to the transfer drum.

However, it is difficult to accomplish exactly the same speed because of the dimensional inaccuracy of the constituent members of the transfer drum, the dimensional inaccuracy of the conveying rollers, the rotational inaccuracy of a driving motor, wearing of the conveying rollers or the like.

When the feeding speed of the conveying rollers is smaller than the conveying speed by the transfer drum, the transfer roller is pulled back by the conveying rollers adjacent the trailing edge with the result of positional deviation of the attracting position, that the transfer material carrying sheet is deformed as shown in FIG. 5A, that the image is not transferred in good order or that misregistration occurs between the first and subsequent toner images. In addition, the transfer material carrying sheet abruptly springs back once the sheet passes through the conveying rollers, thus causing an impact with the result of non-uniform image transfer or the like.

When the feeding speed by the rollers is higher than the conveying speed of the transfer drum, the conveying rollers push the transfer material. In this case, as shown in FIG. 5B, the transfer material carrying sheet is deformed, the transfer material is raised from the transfer material carrying sheet with the result of the inconveniences similar to the above case.

The inconveniences are remarkable if the size of the transfer material is large.

If the sheet is deformed, the transfer deviation occurs upon the superposed image transfer, and therefore, the color reproduction performance is deteriorated in the case of the full-color image forming apparatus. In an extreme case, the transfer material is jammed upon the attraction to the transfer drum or upon the separation therefrom.

SUMMARY OF THE INVENTION

Accordingly, it is a principal object of the present invention to provide an image forming apparatus capable of carrying the recording material on a recording material carrying means without positional deviation.

It is another object of the present invention to provide an image forming apparatus wherein the images can be overlaid without misregistration.

It is a further object of the present invention to provide an image forming apparatus wherein the recording material can be released from a conveying means after a leading edge of the recording material is carried on the recording material carrying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
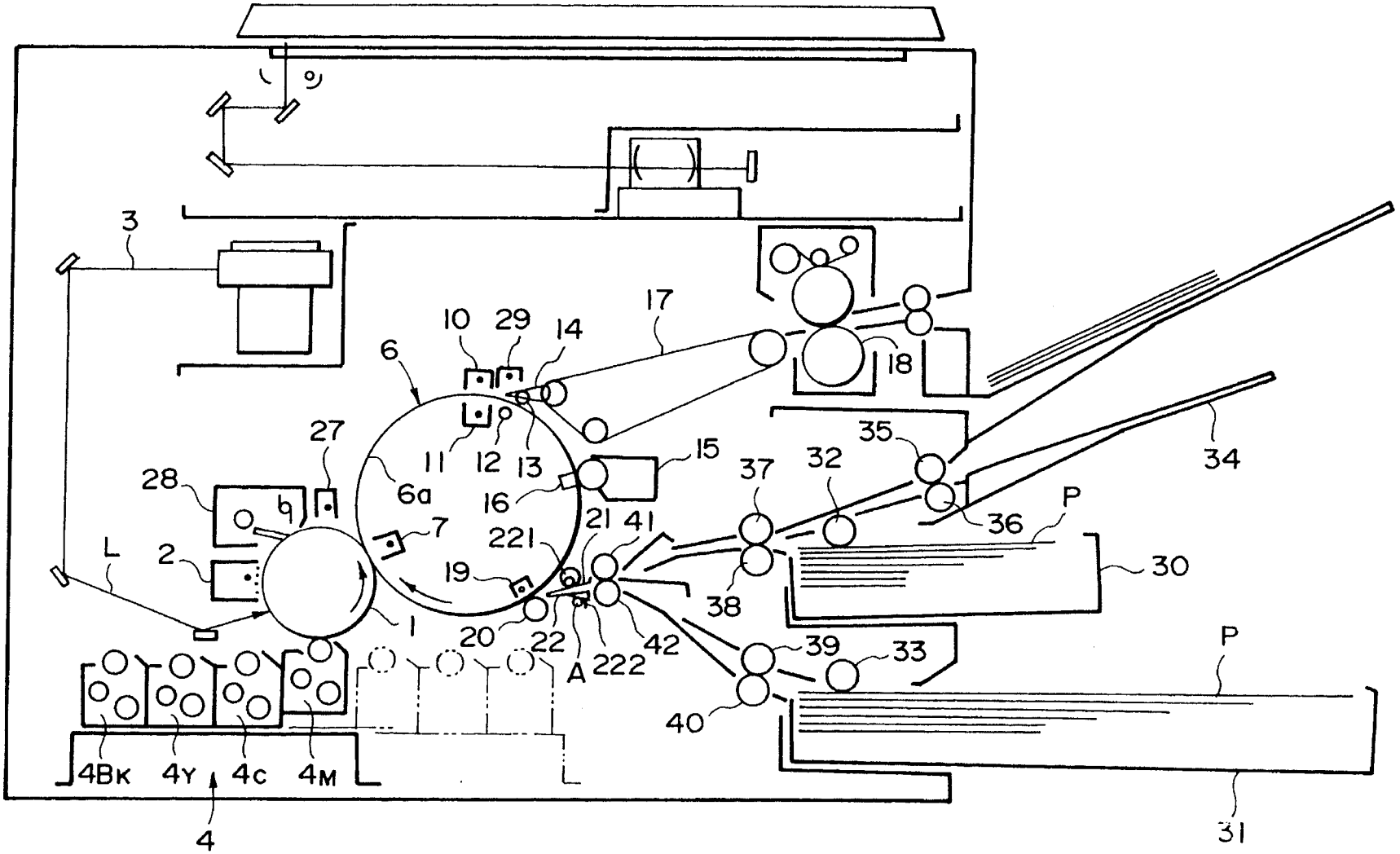
FIG. 1A is a sectional view of an image forming apparatus according to an embodiment of the present invention.
Figure 1B:
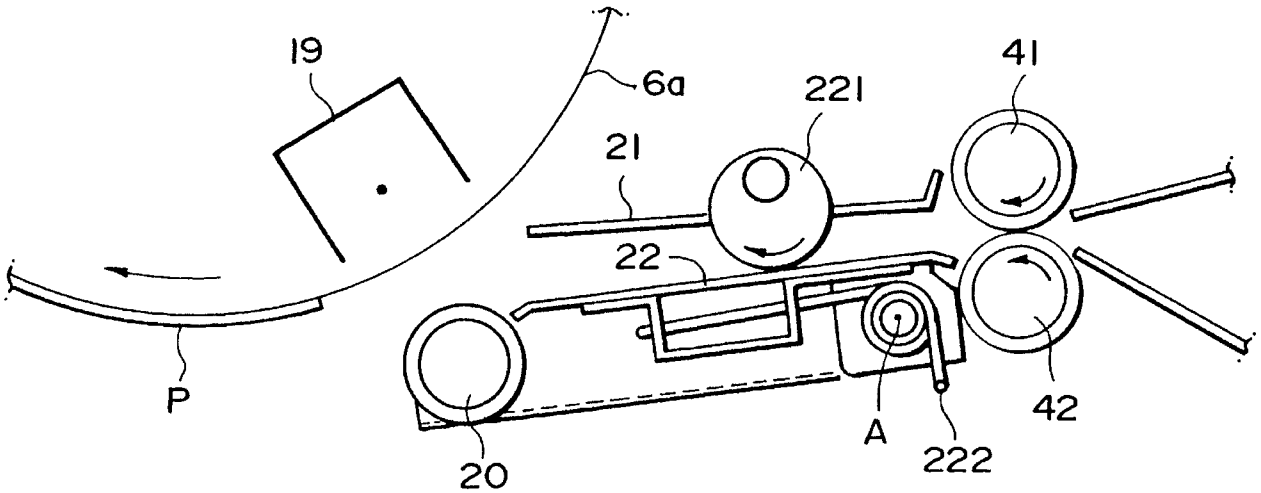
FIG. 1B is a partial enlarged sectional view of the apparatus of FIG. 1A.

Referring to FIGS. 1A and 1B, there is shown a full-color copying machine as an exemplary image forming apparatus according to an embodiment of the present invention, wherein FIG. 1A shows a general arrangement thereof, and FIG. 1B shows a partial enlarged sectional view. The color copying machine comprises, substantially at the central position thereof, an image bearing member in the form of a photosensitive drum 1 which is rotatable in the direction indicated by an arrow. Around the outer periphery thereof, image forming means are disposed. The image forming means may be of any known type. Included in this embodiment are primary charger 2 for uniformly charging the photosensitive drum 1, an optical system 3 in the form of a laser beam scanning optical system or the like for example for exposing the surface of the photosensitive drum 1 to a color separated light image or beam L corresponding thereto so that an electrostatic latent image is formed on the photosensitive drum 1, and a developing device 4 for developing the electrostatic latent image formed on the photosensitive drum 1. These elements are arranged in the order named in the rotational direction of the photosensitive drum 1.

The developing device 4 is a horizontally movable type and is movable in the tangential direction with respect to the outer peripheral surface of the photosensitive drum 1. It comprises four developing means 4M, 4C, 4Y and 4BK for containing magenta color developer, cyan color developer, yellow color developer and black color developer, respectively.

Corresponding to the exposure of the photosensitive drum to the light image or to the beam L corresponding thereto through the optical system 3, the developing device 4 presents a desired developing means by a moving mechanism to a position where it is faced to the outer peripheral surface of the photosensitive drum 1. It electrostatically transfers the developer (powdery toner) to develop the electrostatic latent image on the photosensitive drum 1 so as to form a toner image in the desired color.

Figure 2:
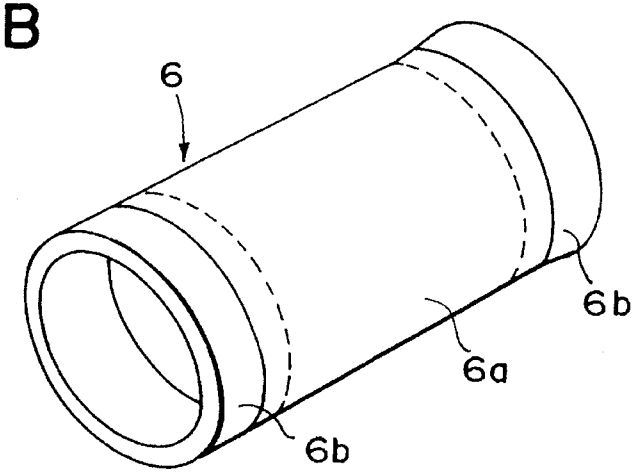
FIG. 2 is a perspective view of a transfer drum used in the apparatus of FIG. 1A.

The toner image formed on the photosensitive drum 1 is transferred onto the transfer material P carried on the transfer device 6. In this embodiment, the transfer device 6 is in the form of a rotatably supported transfer drum. The transfer drum 6 is in contact with the surface of the photosensitive drum 1 or is faced thereto with a small clearance. As shown in FIG. 2, the transfer drum 6 comprises a pair of axially spaced ring members 6*b* and 6*b*, a connecting member (not shown) for connecting them, and a dielectric sleeve (transfer material carrying sleeve) 6*a* covering an opening defined by the ring members and the connecting member. As shown in FIG. 1A, a transfer corona charger 7 is disposed across the transfer material carrying sleeve 6*a* from the photosensitive drum 1, that is, within the transfer drum 6.

At the image transfer position where the transfer drum is faced to the photosensitive drum 1.

The transfer drum 6 is rotated in the direction indicated by an arrow. Upstream of the transfer position where the corona charger 7 is disposed, there are an attraction corona charger 19 in the opposite side of the transfer material carrying surface of the transfer material carrying sleeve 6*a*, that is, in the transfer drum 6, and a conductive roller (charge injection roller) 20, faced to the transfer material carrying surface of the transfer material carrying sleeve 6*a* (in facing relation to the attraction corona charger 19, sandwiching the transfer material carrying sheet). The roller 20 is effective to inject into the recording material a electric charge having a polarity opposite from the polarity of the charge on the transfer material carrying sleeve surface, and therefore, the recording material is electrostatically attracted.

Disposed downstream of the transfer position are two corona chargers 10 and 11 sandwiching the transfer material carrying sleeve 6*a*. Further downstream, there are urging rollers 12 and 13 sandwiching the transfer material carrying sleeve 6*a* to deform the carrying sheet 6*a* to separate the transfer material P from the carrying sheet 6*a*. Adjacent to the rollers 12 and 13, a separating blade 14 having a sharp edge is disposed to the carrying surface. Further downstream thereof, there are a brush roller 15 for cleaning the carrying surface of the transfer material carrying sleeve 6*a* and a corona discharger or a brush type discharger 16 for removing the residual charge.

Adjacent to and downstream of the transfer drum 6, an image fixing device 18 having a pair of fixing rollers is disposed to heat and fix the toner image on the transfer material P which has been separated from the transfer material carrying sleeve 6*a* by the separating blade 14 and conveyed on the conveyer 17.

As shown in FIG. 1A, around the photosensitive drum 1, there are disposed a discharger 27 for removing electrostatic charge from the surface of the photosensitive drum 1 and a cleaning blade 28 for removing the residual toner. As desired, adjacent the separating blade 14, a corona charger 29 for producing AC corona discharge may be produced for the purpose of preventing disturbance of the image resulting from separation discharge upon separation of the transfer material P from the transfer material carrying sleeve 6*a*.

In operation in the full-color mode, the surface of the photosensitive drum 1 is uniformly charged by the primary charger 2 and is exposed to a color image through a green filter for example by the optical system 3 so that an electrostatic latent image to be developed by magenta toner is formed. In synchronism with the formation of the electrostatic latent image, the developing device 4 moves in a horizontal line in the tangential direction relative to the photosensitive drum 1 to present the developing device 4M containing the magenta developer to the position facing to the photosensitive drum 1, so that a magenta toner image is formed on the photosensitive drum 1.

The transfer material P accommodated in a cassette 30 or 31 is singled out from a selected one of the cassettes by a pick-up roller 32 or 33. If the transfer material P is placed on a manual feed tray 34, it is fed by a pair of manual rollers 35 and 36 and is further fed to the inside by a pair of conveying rollers 37 and 38 or by a conveying rollers 39 and 40. The pair of registration rollers 41 and 42 which are not rotated is effective to correct the oblique conveyance of the transfer material P. Then, the transfer material P is supplied to between the top guide 21 and the bottom guide 22 in synchronism with the photosensitive drum and the transfer drum by the pair of registration rollers 41 and 42. The transfer material P is guided by the top and bottom guides and is conveyed to the transfer material supply position (attraction position) where the conductive roller 20 is disposed, along the surface (carrying surface) of the transfer material carrying sleeve 6*a*.

As shown in FIG. 1B, the bottom guide 22 is swingable about a pivot A and is normally urged in the clockwise direction by a coil spring 222 in FIG. 1B. The conductive roller 20 rotatable following the transfer drum is rotatably mounted at an end of the bottom guide 22. When the bottom guide 22 rotates about the pivot A by an eccentric cam 221 by its rotation in the direction indicated by an arrow by a driving means (not shown), the conductive roller 20 moves to and away from the transfer material carrying sleeve 6*a*. The eccentric cam 221 is driven in timed relation with the supply of the transfer material P. When the transfer material P is supplied to the supply position, the conductive roller 20, as shown in FIG. 1A, is correctly positioned so as to be contacted to the transfer material carrying sleeve 6*a*.

After the transfer material P is supplied to the transfer material supply position where the conductive roller 20 is disposed, the transfer material P is electrostatically attracted on the transfer material carrying sleeve 6*a* by the corona charger 19 and is conveyed to an image transfer position where a transfer charger 7 is disposed faced to the photosensitive drum 1. The supply of the transfer material by the registration rollers 41 and 42 and the latent image formation by the optical system 3 are aligned such that the image is aligned with the transfer material.

At the transfer position, the transfer corona charger 7 is operated to produce a transfer electric field to apply to the transfer material carrying sheet 6 the electric charge having a predetermined polarity by which the toner image is transferred onto the transfer material P from the photosensitive drum 1.

In this embodiment, as shown in FIG. 1B, at the time when the trailing edge of the transfer material P passes by the conductive roller 20, the driving means rotates the eccentric cam 221 to the bottom dead point, by which the lower guide 22 is urged to the bottom against the spring force of the coil spring 22 to rotate in the counterclockwise direction about the pivot A, and as a result, the conductive roller 20 is moved to a position far away from the transfer material carrying sleeve 6*a*.

Similarly, a cyan toner image formed on the photosensitive drum is superposedly transferred onto the transfer material P already having the magenta toner image, and then, the yellow toner image and the black toner images are superposedly transferred, sequentially.

The transfer material P supporting layers of the toner image is separated from the transfer drum and is conveyed to the fixing device where the toner images are fixed by heat and pressure into a mixed full-color image.

In the case of a monochromatic image formation, the toner image developed by the selected developing device is immediately separated from the transfer drum.

The description will be made as to the conveying means for conveying the transfer material to the transfer drum. For the simplicity of explanation, sheet supply from the upper cassette 30 will be described, but the sheet supply from the lower cassette 31 is the same.

Figure 3A:
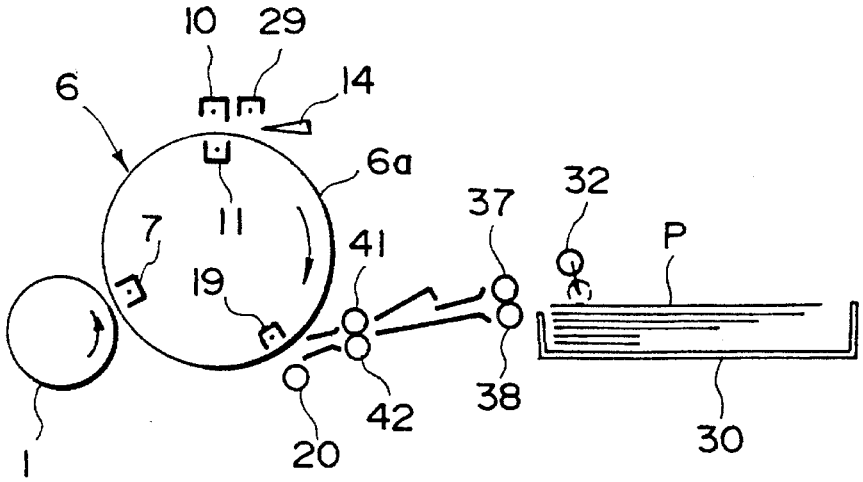
FIGS. 3A, 3B, 3C, 3D, 3E and 3F are sectional views illustrating various manners of transfer material feeding in the image forming apparatus of FIG. 1A.
Figure 3B:
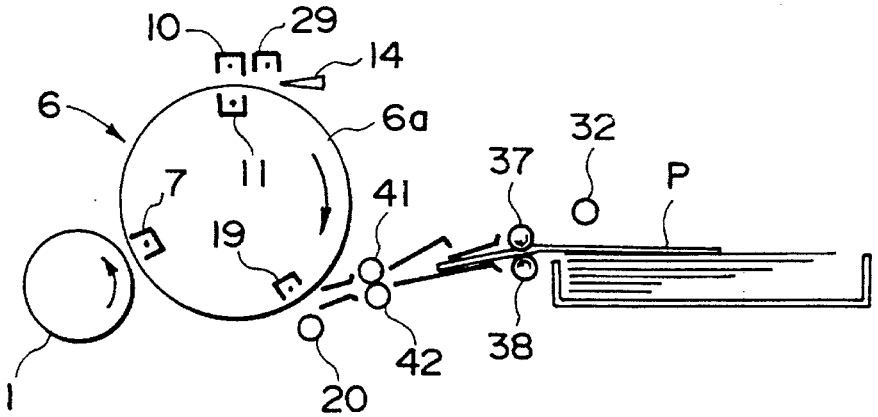
Figure 3C:
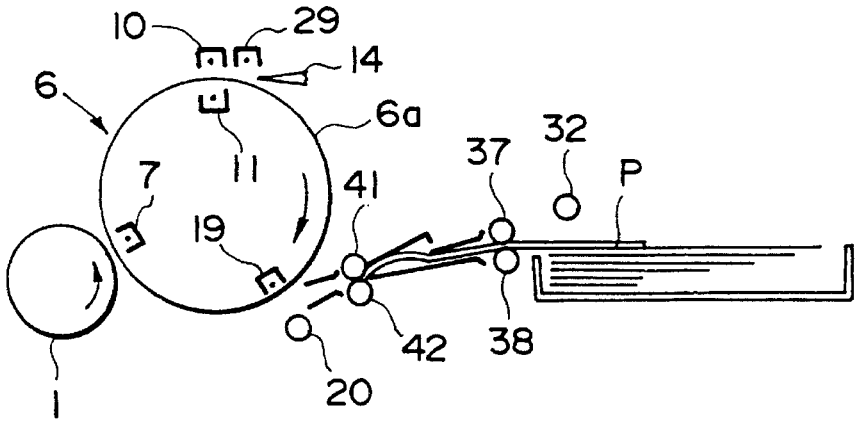
Figure 3D:
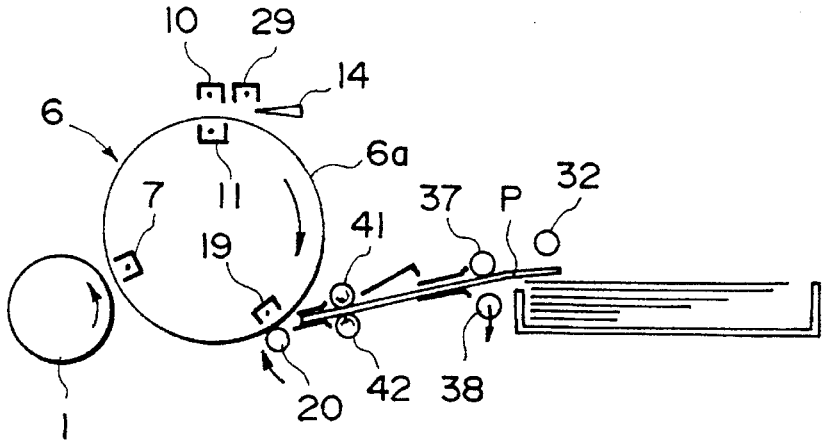

In FIG. 3A, the transfer material P is shown immediately before supply from the cassette 30. The pick-up roller 32 is away from the transfer material P in the cassette 30, and it is press-contacted to the bottommost transfer material P at the sheet feed timing to single it out. The distance of the transfer material feed by the pick-up roller 32 is such that the leading edge of the transfer material P enters a nip formed between conveying rollers 37 and 38. Thereafter, it is retracted again (FIG. 3B). The pick-up roller 32 and the conveying rollers 37 and 38 are started generally at the same time. The pick-up roller 32 may be rotated at its retracted position. The pick-up roller is cylindrical in this embodiment, but it may be a crescent roller which is controlled so as to release the sheet. The conveying rollers 37 and 38 feed the transfer material P until the leading edge of the transfer material reaches the nip formed between the registration rollers 41 and 42, and further feeds until a loop of the transfer material is formed so as to remove the inclination of the transfer material P. Then, the conveying rollers 37 and 38 are stopped (FIG. 3C). The rotation of the registration rollers 41 and 42 are started at such a timing that the transfer material P is aligned with the toner image on the photosensitive drum 1 at the image transfer position. At this time, the eccentric cam 221 rotates ½ turn, by which the conductive roller 20 is brought into contact to the transfer drum 6 so that it starts to rotate following the transfer drum 6 at the same peripheral speed. Simultaneously therewith, an attraction corona charger 19 in the transfer drum 6 starts to operate simultaneously. The leading edge of the transfer material P is introduced into the space between the top and bottom guides 21 and 22, and is guided to the attracting position by the rotation of the registration rollers 41 and 42. At the point of time when the leading edge of the transfer material P slightly passes the nip between the registration rollers 41 and 42, the conveying rollers 37 and 38 grips the neighborhood of the trailing edge of the transfer material P even if the transfer material has a minimum dimension in the direction of the transfer material conveyance. Here, simultaneously with the start of the rotation of the registration rollers 41 and 42 or before the loop of the transfer material P is removed by the rotation of the registration rollers 41 and 42, the nip between the conveying rollers 37 and 38 is released (releasing position shown in FIG. 3D).

Figure 3E:
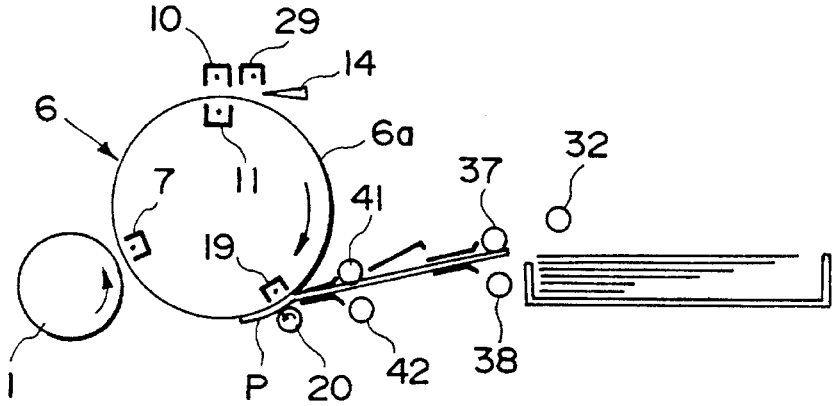

The conveyance of the transfer material P is governed by the registration rollers 41 and 42. However, it is extremely difficult to accomplish the transfer material conveying speed of the transfer drum (transfer material carrying sheet 6*a*) which is exactly the same as the transfer material supplying speed thereto. In view of the difficulty, the registration rollers 41 and 42 are released after the leading edge of the transfer material is attracted onto the transfer drum 6 and before the leading edge of the transfer material reaches the transfer position. At this time, the conveying rollers 37 and 38 and the pick-up roller 32 take the releasing positions, the transfer material P is introduced into the transfer position only by the transfer drum to which it is attracted by the attraction corona charger 19 and the conductive roller 20, even if the transfer material has the maximum usable length (FIG. 3E).

The releasing mechanism for the conveying roller 38 and the registration roller 42 may be of the similar type as for the conductive roller 20.

Thus, even if there is the speed difference between the pair of registration rollers 41 and 42 and the transfer drum 6 (transfer material carrying sheet 6*a*), the transfer material P is not relatively pushed or pulled by the registration rollers 41 and 42. Therefore, it is closely contacted and supported on the transfer material carrying sheet 6*a*, and can be passed through the transfer position at the same peripheral speed as the photosensitive drum.

The experiments by the inventors will now be described. The transfer material carrying sleeve was made of PVDF film having a thickness of 150 microns and was formed into a cylinder having a diameter of 160 mm. The attraction corona charger was supplied with total current of 150 micro-ampere and −6 KV. The conductive roller was a grounded metal roller. It has been confirmed that if the rollers other than the conductive roller are released at the point of time when approximately 50 mm of the leading edge portions of the transfer material is attracted on the transfer material carrying sleeve, the transfer material is closely attracted on the transfer material carrying sleeve without improper attraction, without positional deviation or the like.

Figure 3F:
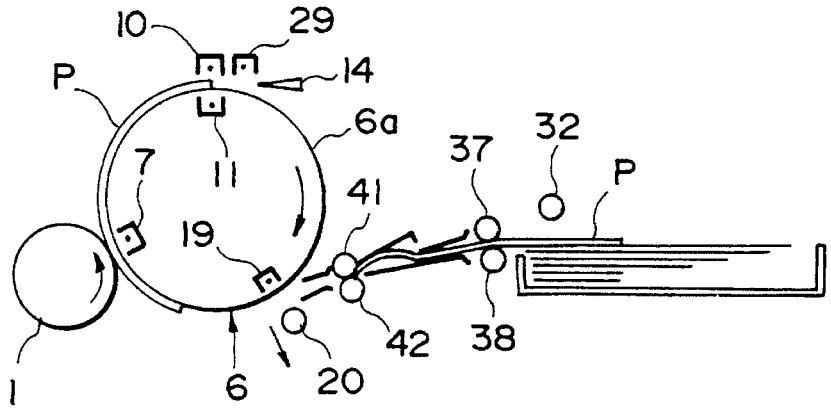

The rollers taking the released position resume the press-contact position after the trailing edge of the transfer material passes through them. FIG. 3F shows the situation when the preceding transfer material is in the separating step in a continuous copy mode.

Thus, after the leading portion of the transfer material is supported on the transfer drum and before the transfer material passed through the nip between the registration rollers, the registration rollers are released, and the conveying rollers within the length of the transfer material are released. Therefore, the transfer material is not at all constrained by any conveying means for supplying the transfer material to the transfer drum. It is a possible alternative that the rollers are not completely released, but the pressure of the nip forming press-contact is reduced. However, the complete release is preferable since then the load is minimum.

Figure 4:
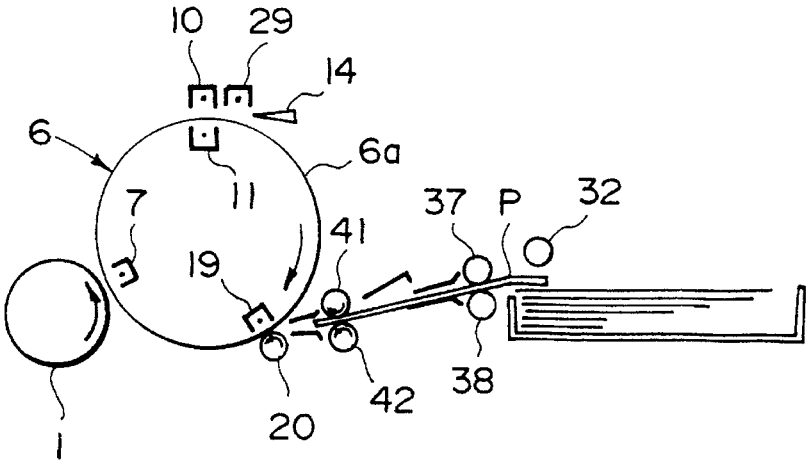
FIG. 4 is a sectional view of an image forming apparatus according to another embodiment of the present invention.
Figure 5A:
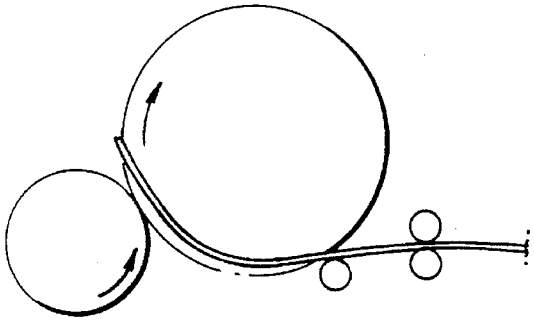
FIGS. 5A and 5B are sectional views illustrating the problem to be solved by the present invention.
Figure 5B:
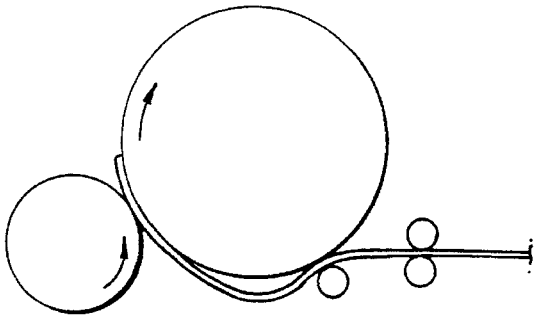

FIG. 4 shows an image forming apparatus according to a second embodiment of the present invention. In this embodiment, the rotation of the conveying rollers 37 and 38 are carried out through a one way clutch (not shown). Then, the conveying rollers 37 and 38 are rotatable idly in the transfer material conveying direction even if the driving power is shut off. In the case of the conveying rollers 37 and 38 driven through the one way clutch, the conveying rollers 37 and 38 keep gripping the transfer material P unlike the case of FIG. 3D, and the rollers are rotated idler by the transfer material P pulled by the registration rollers 41 and 42. In this case, therefore, the registration rollers 41 and 42 are released at the time when a predetermined length of the leading edge portion of the transfer material P is attracted on the transfer material carrying sheet *6a*. It is not necessary to release the conveying rollers 37 and 38. Both of the pair of conveying rollers 37 and 38 and the pair of the registration rollers 41 and 42 may be driven through the respective one way clutches. Then, none of the rollers are required to be released.

However, the load of the idling rotation of the one way clutch is not zero but is at least 30 g 10 cm, and the load varies. If plural loads of the one way clutch are applied, the advancement of the transfer material attracted on the transfer material carrying sheet is retarded although the degree is small. In addition, slight time lag occurs in the drive transmission due to the provision of the one way clutch. Therefore, it is preferable that the registration rollers are driven without the one way clutch because it required correct timing operation to feed the transfer material and that the registration rollers are released, or the pressure therebetween is reduced at the time when the predetermined amount of the leading portions of the transfer sheet is attracted on the transfer material carrying sheet.

When the predetermined amount of the leading portion of the transfer material is attracted on the transfer drum (FIG. 3E), the trailing edge of the transfer material having the usable maximum length has already passed through the nip between the conveying rollers 37 and 38, the releasing operation of the conveying rollers 37 and 38 is not required.

Figure 6:
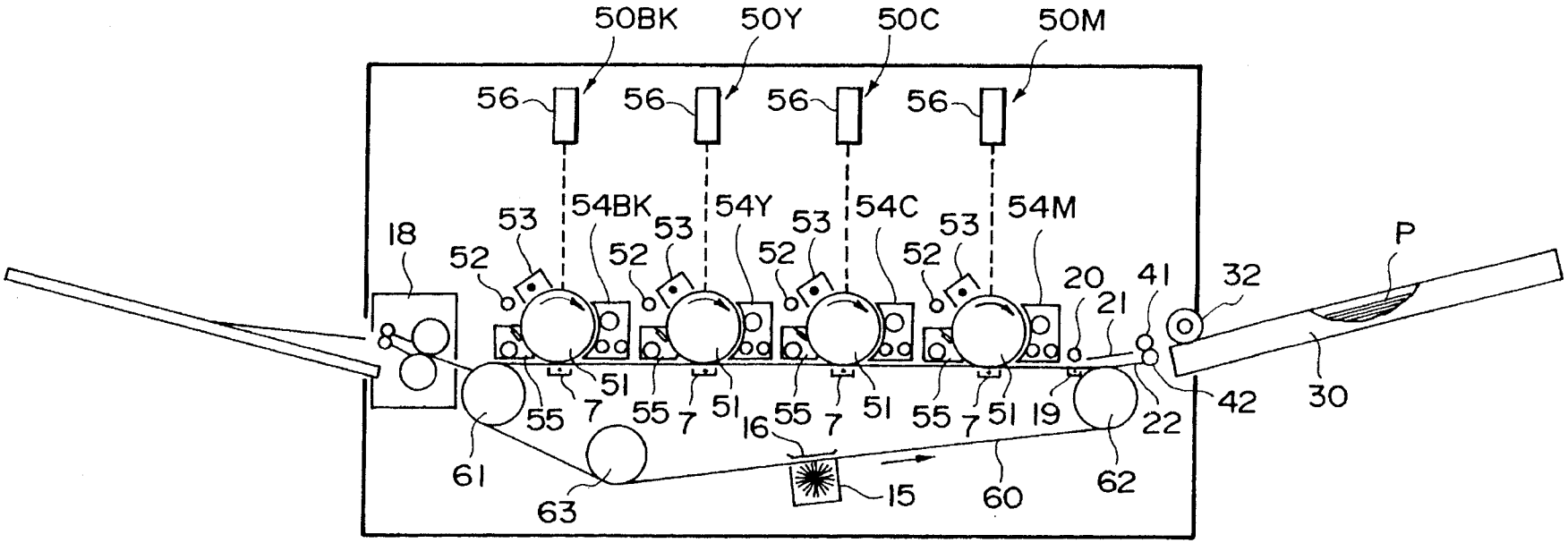
FIG. 6 is a sectional view of an image forming apparatus according to a further embodiment of the present invention.

FIG. 6 illustrates an image forming apparatus according to a further embodiment of the present invention. In this embodiment, the image forming apparatus is an electrophotographic type color copying machine. It is different from the first and second embodiments in that it comprises four image forming stations 50M, 50C, 50Y and 50BK arranged along a line. Each of the image forming stations comprises a photosensitive drum 51 and various means disposed therearound, including an erasing lamp 92, a charger 53, a developing means 54, a cleaner 55 and an image exposure position 56. The first, second, third and fourth image forming stations 50M, 50C, 50Y and 50BK form a magenta image, a cyan image, a yellow image and a black image, respectively. The color separated toner images produced by the image forming stations are overlaid sequentially on the transfer material P. They are fixed at once by the fixing device 18, so that a full-color image is produced. The transfer material P accommodated in a cassette 30 is singled out by a pick-up roller 32 and is supplied by the registration rollers 41 and 42 to an attracting position where a conductive roller 20 and a charger 19 are disposed sandwiching a transfer material carrying member (conveying belt) 60 movable along an endless path. The conductive roller 20 is at the front side and the charger 19 is at the backside. In this embodiment, the conductive roller 20 is always contacted to the conveying belt 60. The conveying belt 60 is stretched around a driving pulley 61, a follower pulley 62 and a tensioner 63. It carries the transfer material P through the four image forming stations to receive the toner image by the transfer chargers 7, and the transfer material is supplied to the fixing device 18.

In the image forming apparatus of this embodiment, the pick-up roller 32 is retracted from the topmost transfer material in the cassette, or the pressure is released, and in addition, when a predetermined length of the leading portion of the transfer material is attracted on the conveying belt 60, the pair of registration rollers 41 and 42 are released, or the pressure therebetween is released, or they are made idly rotatable. By doing so, even if the transfer material has the maximum usable length, the transfer material P is introduced into the transfer position of the first image forming station 50M by the conveying belt 60 to which it is attracted by the attraction corona charger 19 and the conductive roller 20.

Therefore, even if there is a conveying speed difference between the registration rollers 41 and 42 and the conveying belt 60, the transfer material P is not relatively pushed or pulled by the registration rollers 41 and 42, and therefore, it is closely supported on the conveying belt 60. As described, before the leading edge of the transfer material P reaches a transfer position of the most upstream image forming station with respect to the movement direction of the transfer material, the rollers gripping the transfer material P are released, or the pressure is released, or the idle rotation state is established, by which the transfer material can be conveyed while being closely contacted to the conveying belt.

In the foregoing embodiment, the recording material is electrostatically attracted on the recording material carrying member. However, the present invention is not limited to this type. For example, it is applicable to the case of the recording material carrying member having a clamping mechanism to grip a leading edge of the recording material, the case wherein the clamping mechanism and the attraction mechanism are both used or the case in which other means and mechanism are used to grip the recording material on the recording material carrying member.

In the foregoing embodiment, the image forming apparatus is an electrophotographic type. However, the present invention is applicable to an electrostatic recording or other type of copying machine or printer.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

a recording material carrying member for carrying a recording material to an image transfer station where an image is transferred from said image bearing member to the recording material carried on said recording material carrying member;

conveying means for applying conveying force to the recording material at a conveying position to convey the recording material to said recording material carrying member; and releasing means for releasing the conveying force of said conveying means at the conveying position after a leading edge of the recording material is carried on said recording material carrying member and before the leading edge reaches a transfer position.

2. An apparatus according to claim 1, wherein said conveying means includes a pair of rotatable members press-contacted to each other to form a nip for conveying the recording material, and said releasing means separates the rotatable members.

3. An apparatus according to claim 1, wherein said conveying means includes a pair of rotatable members press-contacted to each other to form a nip for conveying the recording material, and said releasing means reduces pressure between the rotatable members.

4. An apparatus according to claim 1, wherein said conveying means includes a pair of rotatable members press-contacted to each other to form a nip for conveying the recording material, and said releasing means makes the rotatable members freely rotatable.

5. An apparatus according to claim 1, wherein said recording material carrying member attracts the recording material thereon, and when a predetermined length of the recording material is attracted, said releasing means releases the recording material.

6. An apparatus according to claim 1, wherein said conveying means includes a pair of registration rollers for feeding the recording material to said recording material carrying member at predetermined timing, and said releasing means releases the recording material from said registration rollers.

7. An apparatus according to claim 1, different color toner images are sequentially formed on said image bearing member, and the toner images are sequentially overlaid on the recording material.

8. An apparatus according to claim 7, further comprising means for fixing overlapped toner images into a full-color image.

9. An image forming apparatus, comprising:

an image bearing member;

a recording material carrying member for carrying a recording material to an image transfer station where an image is transferred from said image bearing member to the recording material carried on said recording material carrying member;

conveying means for applying conveying force to the recording material at a conveying position to convey the recording material to said recording material carrying member;

wherein the conveying force of said conveying means at the conveying position is released after a leading edge of the recording material is carried on said recording material carrying member and before the leading edge reaches a transfer position.

10. An apparatus according to claim 9, wherein said conveying means includes a pair of rotatable members press-contacted to each other to form a nip for conveying the recording material, and the recording material is released by separating the rotatable members.

11. An apparatus according to claim 9, wherein said conveying means includes a pair of rotatable members press-contacted to each other to form a nip for conveying the recording material, and the recording material is released by reducing pressure between the rotatable members.

12. An apparatus according to claim 9, wherein said conveying means includes a pair of rotatable members press-contacted to each other to form a nip for conveying the recording material, and the recording material is released by making the rotatable members freely rotatable.

13. An apparatus according to claim 9, wherein said recording material carrying member attracts the recording material thereon, and when a predetermined length of the recording material is attracted, the recording material is released.

14. An apparatus according to claim 13, wherein said recording material carrying member electrostatically attracts the recording material.

15. An apparatus according to claim 9, wherein said conveying means includes a pair of registration rollers press-contacted to each other to form a nip for conveying the recording material to said recording material carrying member at predetermined timing, and the recording material is released from the registration rollers.

16. An apparatus according to claim 9, different color toner images are sequentially formed on said image bearing member, and the toner images are sequentially overlaid on the recording material.

17. An apparatus according to claim 16, further comprising means for fixing overlapped toner images into a full-color image.

18. An apparatus according to claim 1 or 17, wherein said recording material carrying member comprises a sheet for carrying the recording material.

* * * * *

UNITED STATES PATENT AND TRADEMARK OFFICE

CERTIFICATE OF CORRECTION

PATENT NO. : 5,555,082

DATED : September 10, 1996

INVENTOR(S) : Tanaka et al.

It is certified that error appears in the above-indentified patent and that said Letters Patent is hereby corrected as shown below:

Title page, item
[57] ABSTRACT:

Line 6, delete "means".
Line 7, "for for" should read "for".
Line 8, "the a" should read --the--.

COLUMN 4:

Line 3, "sheet)." should read -- sleeve).--.
Line 12, "sheet 6a" should read --sleeve 6a--.
Line 13, "sheet 6a" should read --sleeve 6a--.

COLUMN 6:

Line 33, "sheet 6a)" should read --sleeve 6a)--.
Line 35, "of the" should read --of this--.
Line 51, "sheet 6a)" should read --sleeve 6a)--.

UNITED STATES PATENT AND TRADEMARK OFFICE

CERTIFICATE OF CORRECTION

PATENT NO. : 5,555,082

DATED : September 10, 1996

INVENTOR(S) : Tanaka et al.

It is certified that error appears in the above-indentified patent and that said Letters Patent is hereby corrected as shown below:

COLUMN 7:

Line 36, "sheet 6a" should read --sleeve 6a--.

COLUMN 9:

Line 47, "different" should read --wherein different--.

COLUMN 10:

Line 5, "member;" should read --member; and--.
Line 45, "different" should read --wherein different--.

Signed and Sealed this

Eleventh Day of March, 1997

*Attest:*

*Attesting Officer*

BRUCE LEHMAN

*Commissioner of Patents and Trademarks*